US006023909A

United States Patent [19]

Boldrini

[11] Patent Number: 6,023,909

[45] Date of Patent: Feb. 15, 2000

[54] PACKING MACHINE

[75] Inventor: Fulvio Boldrini, Ferrara, Italy

[73] Assignee: G.D. Societa' per Azioni, Bologna, Italy

[21] Appl. No.: 09/146,621

[22] Filed: Sep. 3, 1998

[30] Foreign Application Priority Data

Sep. 4, 1997 [IT] Italy ..... B097A0535

[51] Int. Cl.[7] ..... B65B 19/22

[52] U.S. Cl. ..... 53/234; 53/232; 53/251; 493/910

[58] Field of Search ..... 53/234, 233, 232, 53/225, 224, 223, 228, 466, 461, 251, 250, 252, 253; 493/911, 910

[56] References Cited

U.S. PATENT DOCUMENTS

| | | | |
|---|---|---|---|
| 3,439,473 | 4/1969 | Focke et al. | 53/234 |
| 4,866,912 | 9/1989 | Deutsch | 53/466 X |
| 4,999,970 | 3/1991 | Bamrungbhuet et al. | 53/234 X |
| 5,216,869 | 6/1993 | Boldrini et al. | 53/234 X |
| 5,727,360 | 3/1998 | Focke | 53/234 X |

FOREIGN PATENT DOCUMENTS

| | | |
|---|---|---|
| 0295557 | 12/1988 | European Pat. Off. . |
| 9703878 | 2/1997 | WIPO . |

*Primary Examiner*—James F. Coan

*Attorney, Agent, or Firm*—Marshall, O'Toole, Gerstein, Murray & Borun

[57] ABSTRACT

A packing machine for producing semi-finished packets of cigarettes having respective blanks of packing material and respective wrappings, wherein a forming drum rotates continuously about a given axis to form the packets by partially folding the blanks about the respective wrappings; the drum being located along a packing path having an input branch, an output branch, and an intermediate branch defined by the drum and extending substantially in a spiral about the given axis; the input branch and the output branch being straight and tangent to the intermediate branch; and the drum having a number of orienting assemblies for feeding the packets to the output branch with respective longitudinal axes of the packets oriented parallel to an output direction.

32 Claims, 3 Drawing Sheets

PACKING MACHINE

BACKGROUND OF THE INVENTION

The present invention relates to a packing machine.

In particular, the present invention relates to a packing machine for forming semi-finished packets of cigarettes.

Known cigarette packing machines normally comprise a wrapping conveyor for producing a succession of wrappings, each containing a respective group of cigarettes; an overwrapping conveyor for receiving the wrappings from the wrapping conveyor at a transfer station, and folding a respective blank partially about each wrapping to form a semi-finished packet of cigarettes; and an output conveyor for orienting the semi-finished packets and finish-folding the blanks about the respective wrappings.

More specifically, the wrapping conveyor and the overwrapping conveyor are arranged in series along a straight input portion of a packing path, and comprise respective conveying branches located side by side at said transfer station, and respective numbers of conveying pockets for respectively feeding the wrappings and the packets crosswise to the long longitudinal axes of the wrappings and packets, and which are engaged longitudinally by an unloading device at the transfer station to transfer each wrapping from one pocket to another.

The output conveyor of packing machines of the above type is normally defined by a carousel conveyor comprising a number of conveying heads for removing the packets off the overwrapping conveyor, orienting the packets, and feeding them along a straight output portion of the path crosswise to said input portion.

Known packing machines of the above type involve numerous technical, functional and structural drawbacks on account of the series arrangement of the conveyors along the packing path, which results in an extremely bulky machine and, consequently, in in-plant layout problems during installation. Moreover, in most cases, the packets are transferred between the conveyors and between the overwrapping conveyor and unloading device with no provision for firmly and accurately retaining the wrappings or packets, i.e. with no provision for preventing the wrappings or packets, which are not yet stabilized, from tearing. Finally, employing an unloading device of the type described, or for that matter any known unloading device, prevents not only the formation of a completely straight packing path, but also the attainment of high output speeds.

SUMMARY OF THE INVENTION

It is an object of the present invention to provide a packing machine for producing semi-finished packets of cigarettes, designed to eliminate the aforementioned drawbacks in a straightforward, low-cost manner, and which also provides for achieving high output speeds with in impairment in product quality.

According to the present invention, there is provided a packing machine for producing semi-finished packets of cigarettes, each comprising an inner wrapping, a collar, and a blank of packing material partially folded about the inner wrapping and the collar, the machine comprising a packing path having an input branch, an intermediate branch and an output branch, the intermediate branch being connected to the input and output branches at an input station and an output station respectively; input conveying means extending along the input branch to feed, in a given first direction, a succession of inner wrappings crosswise to respective longitudinal axes and with a given first orientation; packing conveying means extending between a first and a second transfer station located along said intermediate branch to receive said inner wrappings at the first transfer station, and to partially enclose the inner wrappings in respective blanks of packing material to form said semi-finished packets; orienting conveying means located along said intermediate branch to receive the packets at the second transfer station, and to orient the inner wrappings and respective packets; output conveying means located along the output branch to feed the packets in a given second direction and parallel to respective longitudinal axes coincident with the longitudinal axes of the respective inner wrappings, and with a given second orientation rotated 90° with respect to the first orientation; and transfer means associated with said conveying means to transfer said inner wrappings at said first transfer station, and said packets at said second transfer station; the machine being characterized in that said given directions are parallel; said input and output branches are straight branches; and said intermediate branch winds substantially in a spiral about a given axis crosswise to said given directions.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
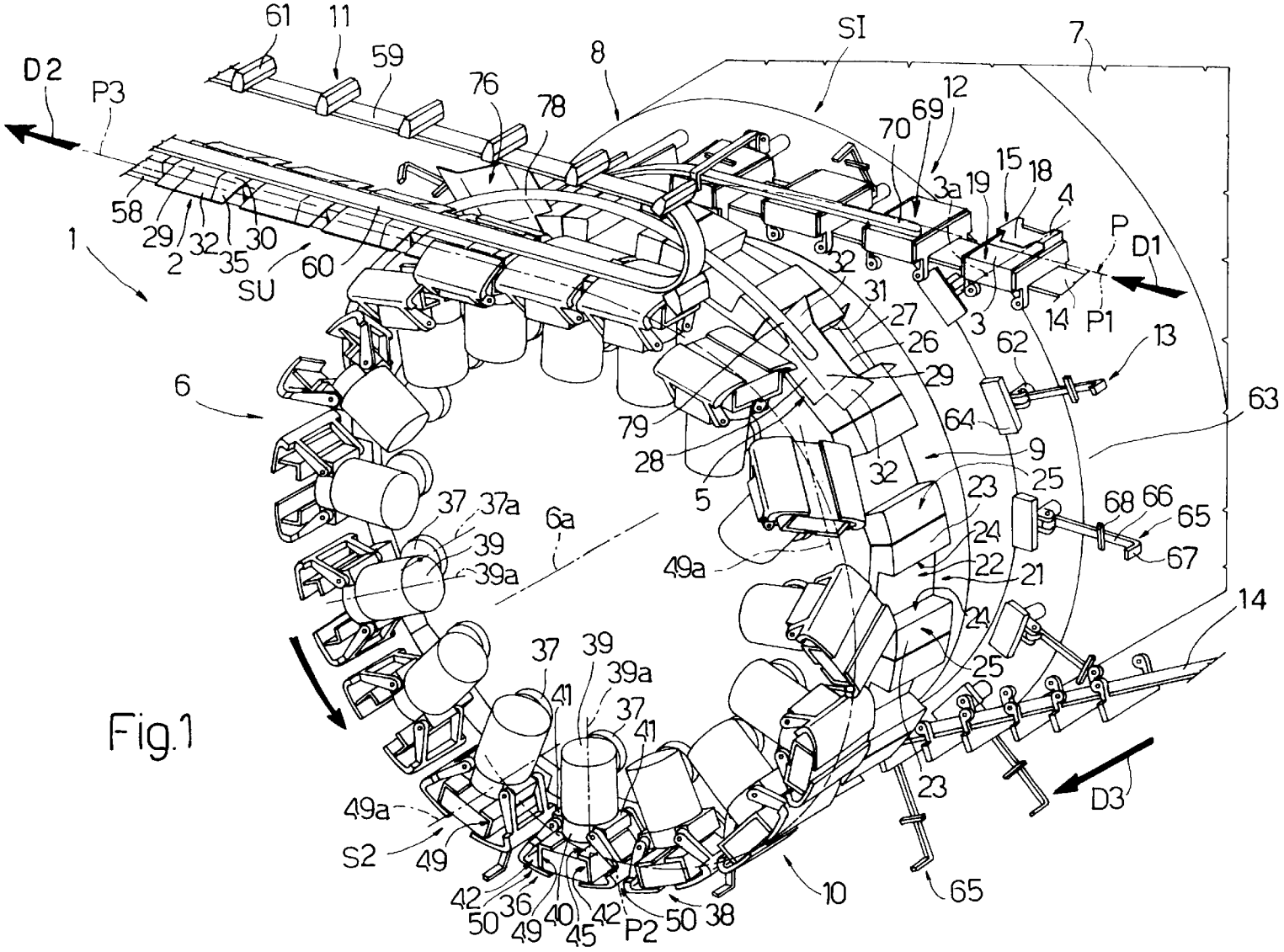
FIG. 1 shows a schematic front view in perspective, with parts removed for clarity, of a packing machine in accordance with the present invention.

Number 1 in FIG. 1 indicates as a whole a packing machine for producing semi-finished packets 2 of cigarettes (not shown), each comprising an inner wrapping 3 enclosing a group (not shown) of cigarettes, a collar 4 on wrapping 3, and a blank 5 of packing material folded partially about wrapping 3 and collar 4.

Machine 1 comprises a forming drum 6, which is fitted to a frame 7 so as to rotate about a horizontal axis 6*a* of rotation, and in turn comprises three transverse cylindrical sections 8, 9, 10 arranged side by side and crosswise to axis 6*a*. Section 8 is an inner transmission section for receiving wrappings 3 and collars 4 at an input station SI; section 9 is an intermediate folding section for receiving wrappings 3 and collars 4 from section 8 at a first transfer station S1 (FIG. 2) and forming packets 2; and section 10 is an outer orienting section for orienting packets 2, and is located axially outwards of drum 6, on the opposite side of section 9 to section 8, to receive packets 2 from section 9 at a second transfer station S2.

Machine 1 also comprises an output conveying device 11 substantially tangent to section 10 at an output station SU to receive packets 2 from section 10; an input conveying device 12 connected to section 8 to feed wrappings 3 and respective collars 4 to drum 6 at station SI; and a transfer device 13 associated with drum 6 to transfer wrappings 3 and collars 4 from section 8 to section 9 along station S1, and to transfer semi-finished packets 2 from section 9 to section 10 along station S2, while securing both wrappings 3 and packets 2 in respective stable configurations.

Stations SI, S1, S2 and SU are arranged in series in the traveling direction of wrappings 3 and packets 2 along a packing path P, which comprises a substantially straight input branch P1 defined by conveying device 12 and along which wrappings 3 are fed crosswise to respective long longitudinal axes 3*a* and in a given direction D1; a substantially spiral intermediate branch P2 extending 360° about axis 6*a* and substantially defined by drum 6; and a substantially straight output branch P3 parallel to branch P1, defined by conveying device 11, and along which packets 2 are fed parallel to respective long longitudinal axes 2*a* corresponding to axes 3*a* of wrappings 3, and in a given direction D2 parallel to direction D1. Branch P1 is tangent to branch P2 at station SI, and branch P3 is tangent to branch P2 at station SU.

Input conveying device 12 comprises a conveyor belt 14 looped about two pulleys, the only one of which shown is a drive pulley defined by section 8 of drum 6. Conveying device 12 also comprises a number of conveying pockets 15 equally spaced with a given spacing K1 along belt 14, and each of which comprises a common bottom wall defined by belt 14 and defined at the top by a respective flat bottom surface 16, and two lateral walls 17 crosswise to belt 14 and to direction D1 (FIG. 3). More specifically, each conveying pocket 15 contains a wrapping 3 and a collar 4, which is arranged with a respective central panel 18 substantially detached from a large lateral surface 19 of wrapping 3 facing outwards of pocket 15, and with two wings 18*a* (FIG. 2) gripped between two walls 17 and two respective small lateral surfaces of wrapping 3. Walls 17 of each pocket 15 are mounted for rotation about respective hinges 20 crosswise to direction D1 and parallel to axis 6*a* to enable a known cam-tappet control device (not shown) to orient walls 17 along stations SI and S1 while maintaining contact between walls 17 and said small lateral surfaces along the portion of belt 14 extending about section 8.

Intermediate folding section 9 has an outside diameter substantially equal to the outside diameter of section 8, is angularly integral with section 8 and section 10, and comprises a number of folding pockets 21, which are equally spaced along the periphery of section 9 and about axis 6*a* with a spacing K2 equal to spacing K1, are defined at the bottom by respective bottom surfaces 22 and laterally by respective pairs of lateral walls 23 crosswise to surfaces 22, and each receive in succession a respective blank 5 and a respective wrapping 3 with collar 4. The bottom surface 22 of each pocket 21 is tangent to the periphery of section 9 and coplanar with bottom surfaces 16 of pockets 15 along station SI, and walls 23 are defined inwards of pocket 21 by respective inner lateral surfaces 24 crosswise to surface 22, and are defined radially outwards of section 9 by respective supporting surfaces 25 substantially parallel to surface 22.

Blanks 5 are fed in known manner into respective pockets 21 upstream from station SI, and are folded in known manner inside pockets 21 into a given prefolding configuration to subsequently receive respective wrappings 3 with collars 4. Blanks 5 are of the type commonly used in the tobacco industry, and each comprise a central panel 26 defining a rear wall of respective packet 2; two end panels 27 and 28 connected to opposite ends of panel 26 along respective preformed transverse bend lines, and defining respective end walls of respective packet 2; a large lateral panel 29 connected to panel 28 along a respective preformed transverse bend line and defining a bottom portion of a front wall of respective packet 2; a further lateral panel 30 connected to panel 27 along a respective preformed transverse bend line and defining a top portion of said front wall; two longitudinal lateral panels 31 connected to opposite sides of panel 26 along respective preformed longitudinal bend lines, and defining respective inner portions of respective small lateral walls of a respective finished packet (not shown); a further two longitudinal lateral panels 32 connected to opposite sides of panel 29 along respective preformed longitudinal bend lines; for each panel 31, two substantially square panels or tabs 33 and 34 connected to respective panels 31 along respective preformed transverse bend lines, and respectively extending alongside panels 27 and 28; and two substantially trapezoidal panels or tabs 35, which are connected by the respective long sides to panel 30 along respective preformed longitudinal bend lines, and define, with respective panels 32, respective outer portions of said small lateral walls of said finished packet.

In said given prefolding configuration, each blank 5 is housed inside respective pocket 21 with panel 26 and panels 31 respectively contacting bottom surface 22 and inner lateral surfaces 24; panels 28 and 29 face section 10 and are folded substantially 90° with respect to panel 26; panel 29 projects radially outwards of pocket 21 with respect to surfaces 25 of pocket 21; panels 27 and 30 project outwards of pocket 21 towards section 8, and slope towards axis 6*a* with respect to panel 26; tabs 34 are folded towards each other, are folded 90° with respect to panel 31, and face panel 28; and tabs 33 are parted and extend outwards of pocket 21 and on either side of panel 27 to define a funnel-shaped conduit to assist subsequent insertion of wrapping 3 onto blank 5.

Outer orienting section 10 comprises a number of orienting assemblies 36 equally spaced about axis 6*a* with a spacing K3, and each comprising a tubular actuating and supporting shaft 37, which extends outwards of drum 6 along a respective axis 37*a* parallel to axis 6*a*, and is mounted for rotation about axis 37*a* and with respect to drum 6. Each assembly 36 also comprises an orienting pocket 38 of variable shape; and a cup-shaped cylindrical body 39 for supporting pocket 38 and connected to the end of respective shaft 37 projecting outwards of drum 6. More specifically, each body 39 is connected to respective shaft 37 eccentrically with respect to the axis 37*a* of rotation of shaft 37, extends radially with respect to axis 6*a* and along a respective longitudinal axis 39*a* crosswise to respective axis 37*a*, and houses a known device for controlling and actuating respective pocket 38.

Figure 4:
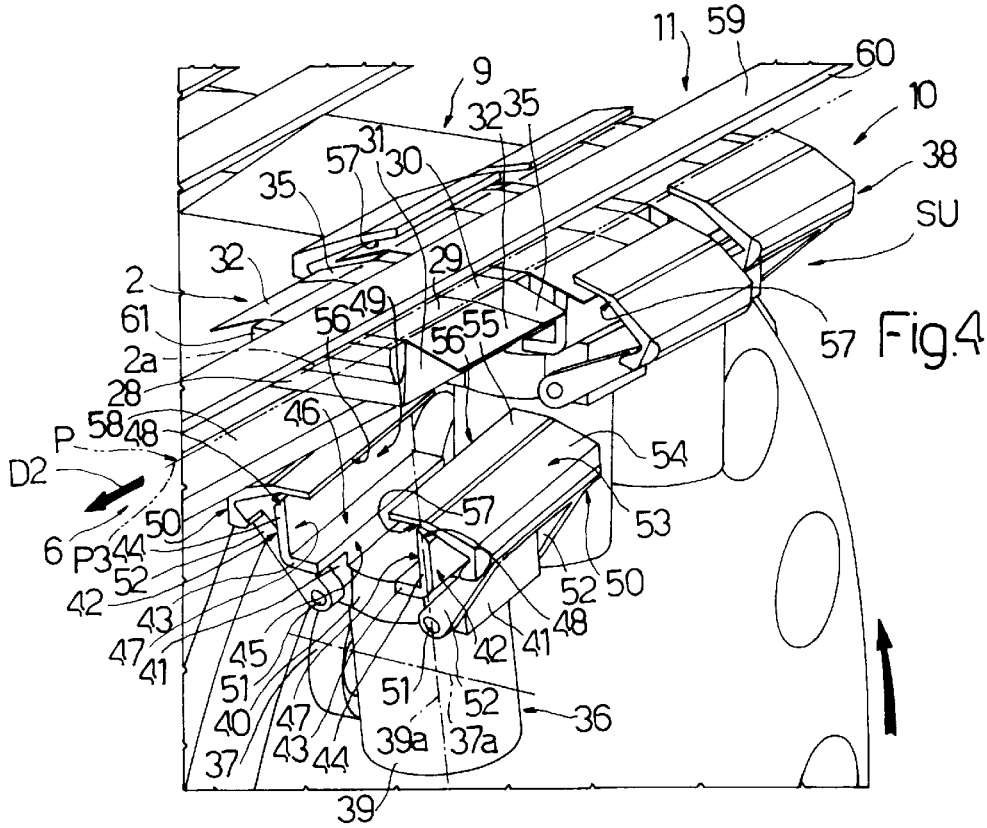

As shown in FIG. 4, each pocket 38 comprises a cylindrical cap 40, which is mounted for rotation about axis 39*a* to close respective body 39, faces radially outwards of section 10, and in turn comprises two substantially parallelepiped brackets 41 connected laterally to cap 40 on radially opposite sides of axis 39*a*, and two fixed L-shaped lateral walls 42 connected to the top of brackets 41. Brackets 41 have respective through holes (not shown) parallel to each other and crosswise to respective axis 39*a*; each wall 42 comprises two flat portions 43 and 44 perpendicular to each other; and each portion 43 extends crosswise to axis 39*a* by a length substantially equal to the length of packets 2 measured parallel to axes 2*a*, and defines, with the other portion 43, a central longitudinal groove 45 extending towards cap 40 from respective top surfaces 46 of portions 43.

Each portion 44 extends, parallel to axis 39*a* and on the opposite side to groove 45, from surface 46 of respective portion 43 by a length equal to the thickness of packet 2, comprises a lateral surface 47 crosswise to surface 46 and facing the other surface 47, and is defined at the top by a respective longitudinal edge 48 beveled on the opposite side to surface 47. Surfaces 46 and surfaces 47 define a U-shaped seat 49 having a rectangular cross section to receive a respective packet 2, and through the whole length of which groove 45 extends.

Each pocket 38 also comprises two movable lateral walls 50, which are located on radially opposite sides of respective axis 39*a*, are hinged to respective control shafts 51 mounted for rotation through said through holes in brackets 41, and are movable, to vary the configuration of pocket 38, between a half-closed position in which walls 50 are positioned substantially close to each other and substantially contacting edges 48 of respective walls 42, and a half-open position in which walls 50 are separated from each other and from edges 48. More specifically, each wall 50 comprises two arms 52 fitted to opposite ends of respective shaft 51; and a shaped plate 53, a substantially V-shaped portion 54 of which is connected to arms 52, and a flat portion 55 of which extends from portion 54 towards seat 49 and, when walls 50 are in the half-closed position, is positioned coplanar with surface 46, has a respective free longitudinal edge 56 facing over respective seat 49, and has a respective shaped longitudinal edge 57—for connection to portion 54—substantially contacting respective edge 48.

Finally, said control and actuating device provides for rotating respective pocket 38, by a substantially 90° angle, between a loading position (FIG. 3) in which pocket 38 is moving along station S2 and a longitudinal axis 49*a* of respective seat 49 is parallel to axis 6*a* of drum 6 to receive a respective packet 2, and an unloading position (FIG. 4) in which pocket 38 is moving along station SU and axis 49*a* is parallel to direction D2 to feed respective packet 2 to output conveying device 11.

Output conveying device 11 comprises an elongated plate 58 extending from station SU along branch P3 of path P in direction D2; and a belt 59 looped about two pulleys (not shown) having respective axes parallel to axis 6*a*, and defining, on belt 59, a loading branch 60 parallel to plate 58. Conveying device 11 also comprises a number of projections 61 equally spaced along belt 59, and which provide for engaging the ends of packets 2 housed inside seats 49 traveling through station SU, to extract packets 2 from seats 49 and feed them along branch P3 on plate 58. More specifically, projections 61 are inserted between edges 56 of walls 50 in the half-open position, and, as explained clearly later on, travel in direction D2 at a speed V3 greater than the traveling speed V2 of seats 49 through station SU.

For each assembly 36, transfer device 13 comprises a respective push shaft 62, which is fitted in axially-sliding manner through a shoulder 63 of portion 8, is fitted on one end with a rectangular plate 64 crosswise to shaft 62 itself, and is moved, by a further known control and actuating device (not shown) and in an extraction direction D3 crosswise to directions D1 and D2, between a withdrawn rest position in which plate 64 is close to shoulder 63 and outwards of pockets 15, and a first and second extracted work position: in the first extracted position, plate 64 is positioned substantially facing respective pocket 21 to insert inside pocket 21 a respective wrapping 3 and collar 4 extracted from respective pocket 15; and in the second extracted position, plate 64 is positioned facing a seat 49 to insert inside seat 49 a packet 2 extracted from pocket 21.

Figure 2:
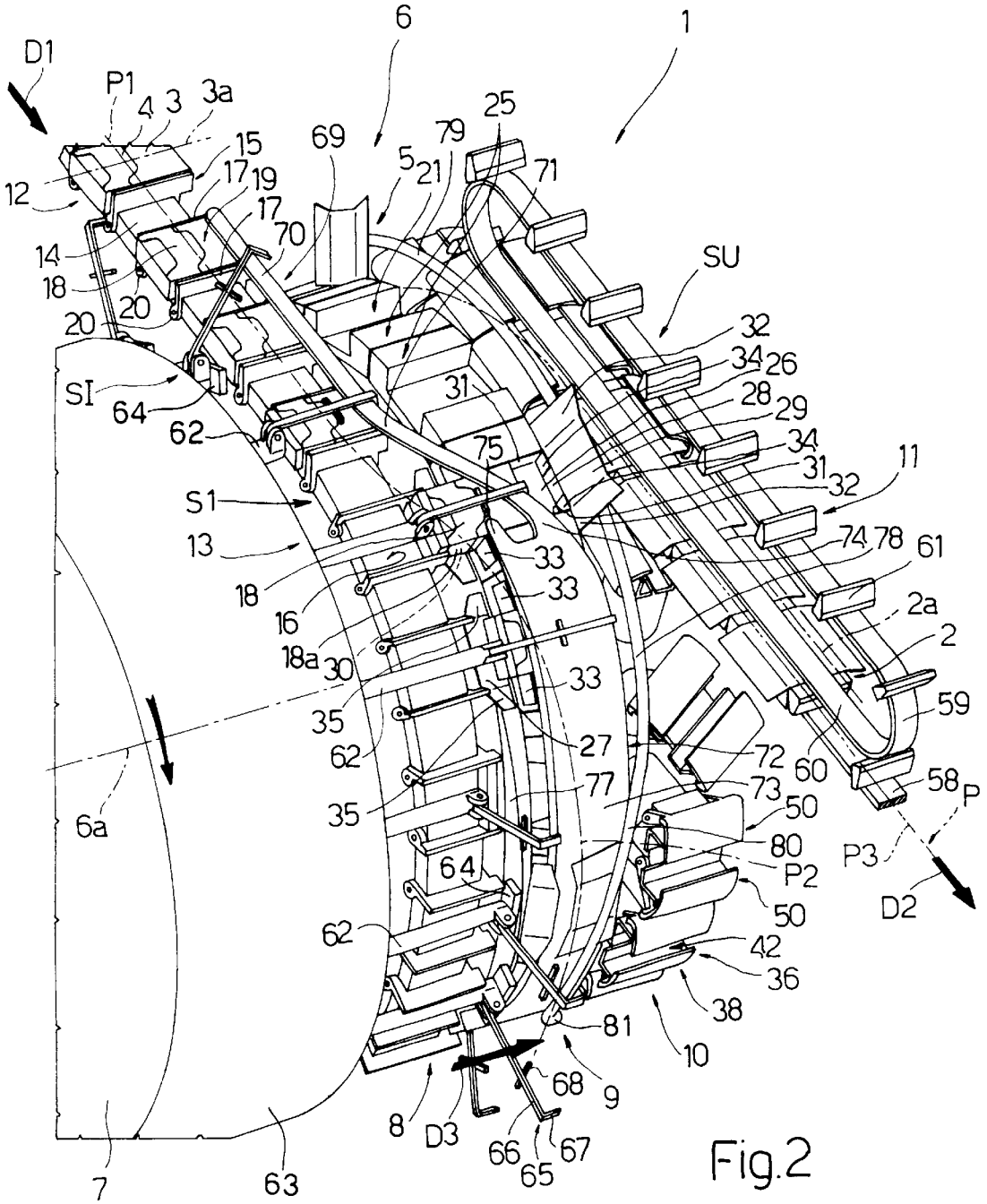
FIG. 2 shows a schematic side view in perspective, with parts removed for clarity, of the FIG. 1 machine.
Figure 3:
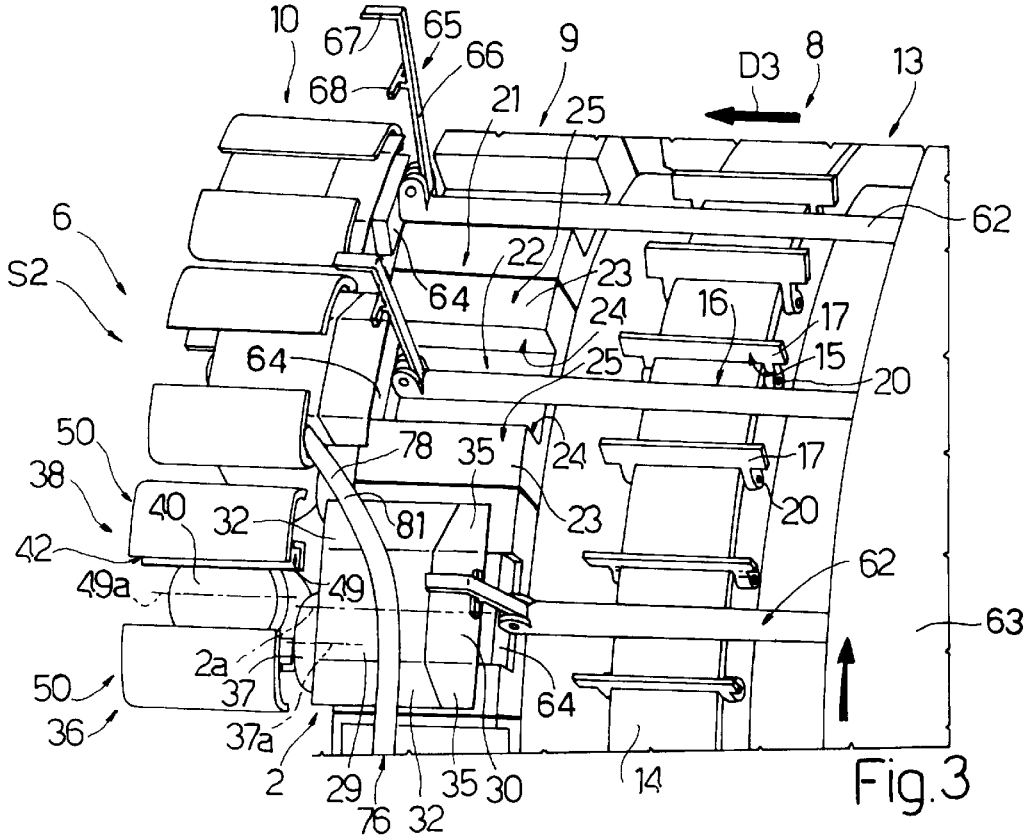
FIGS. 3 and 4 show larger-scale views in perspective, with parts removed for clarity, of two details in FIG. 1.

As shown in FIG. 2, transfer device 13 also comprises, for each shaft 62, a clamping hook 65, which is hinged to shaft 62, substantially at respective plate 64, and is movable, also by said further control and actuating device, between a raised position and a lowered clamping position in which hook 65 cooperates with plate 64 to clamp respective wrapping 3 and collar 4 in a stable configuration to prevent any relative movement between collar 4 and wrapping 3, and also to hold wrapping 3 together. Each hook 65 is substantially L-shaped, and comprises a rod 66 hinged to respective shaft 62, and a tooth 67 formed by bending an end portion of rod 66 through 90°, and which engages the end of respective wrapping 3 on the opposite side to that engaged by plate 64. Each hook 65 also comprises a bar 68, which is fitted along respective rod 66, in an intermediate position between tooth 67 and the pivot of rod 66, and which is positioned on large lateral surface 19 of wrapping 3 and on central panel 18 of respective collar 4 to clamp collar 4 in a given position with respect to wrapping 3, and to prevent collar 4 from sliding longitudinally as wrapping 3 is transferred from pocket 15 to pocket 21.

Device 13 also comprises a guiding and clamping element 69, which extends along path P, astride sections 8 and 9 and between stations SI, S1, S2, and cooperates with said further control and actuating device of shafts 62 to move shafts 62 axially in direction D3, to operate hooks 65, and to assist in clamping packets 2 in a stable configuration as packets 2 are transferred between pockets 21 and pockets 38. Element 69 comprises a substantially straight initial portion 70 extending parallel to direction D1, along branch P1 up to station SI, and substantially over conveying pockets 15; an oblique intermediate portion 71 sloping outwards of drum 6 with respect to direction D1, and extending through station S1; and an end portion 72.

End portion 72 comprises a curved plate 73 located at section 9 and substantially contacting surfaces 25 of pockets 21; a curved portion 74 connecting plate 73 and portion 71; and a wedge-shaped element 75 located alongside portion 74 and extending from plate 73 along the periphery of section 9 of drum 6 in the opposite direction to the rotation direction of drum 6. More specifically, element 75 wedges itself between rods 66 and supporting surfaces 25 of pockets 21 to substantially detach teeth 67 from wrappings 3 and portion 74, while at the same time pressing panels 18 of collars 4 on respective surfaces 19 as wrappings 3 are transferred from pockets 15 to pockets 21.

Finally, machine 1 comprises a folding device 76, which cooperates with drum 6 to fold each blank 5, as of the prefolding configuration, about respective wrapping 3 to form packet 2. Device 76 comprises two folding elements (not shown) mounted to the side of lateral walls 23 of pockets 21, and movable towards each other to squarely fold tabs 33; and a helical plate 77 (FIG. 2) located between sections 8 and 9, along the portion of branch P2 extending between stations S1 and S2, and which provides for squarely folding panels 30 with respect to respective panels 27, and then folding panels 27 with respect to panels 26 to position panels 30 on plate 73.

Device 76 also comprises a folding element 78, which is mounted in a fixed position along the periphery of section 9, has a substantially circular cross section, and in turn comprises an initial portion 79 mounted, upstream from station Si, to the side of pockets 21 between sections 9 and 10 and crosswise to axis 6*a*, and an oblique intermediate portion 80 extending axially inwards of drum 6 and over plate 73 to engage and fold panels 29 and 32 onto plate 73 and into a position substantially coplanar with respective panels 30. Element 78 also comprises a curved end portion 81 located at station S2 and extending outwards of drum 6 to accompany and maintain panels 29, 32, 30 clamped to one another and contacting large lateral surface 19 of wrapping 3 as packet 2 is transferred from pocket 21 to pocket 38.

In actual use, drum 6 rotates continuously about respective axis 6*a* at a constant angular speed W; belt 14 of input conveying device 12 is therefore operated continuously, and pockets 15 are fed along branch P1 of path P and through input station SI at a given traveling speed V1 proportional to speed W of drum 6 and equal to the surface speed V2 of pockets 21 and 38; projections 61 of output conveying device 11 are fed continuously at speed V3 in direction D2 along branch P3 of path P; and rotation of drum 6 not only activates said cam-tappet control device to move lateral walls 17 of pockets 15, but also operates said control and actuating devices of pockets 38 and shafts 51 and 62.

For the sake of simplicity, operation of machine 1 will be described with reference to the formation of one semi-finished packet 2, i.e. a packet 2 wherein respective blank 5 is only partially folded about respective wrapping 3 and collar 4 along path P, and, on reaching output station SU, has panels 31 folded squarely, and panels 32 projecting laterally from panels 31.

Inner wrapping 3 with collar 4 is fed by belt 14 along branch P1 of path P, and is supplied to input station SI housed inside respective conveying pocket 15 with respective axis 3*a* crosswise to direction D1 and parallel to direction D3. As the portion of belt 14 conveying pocket 15 enters station SI, said cam-tappet device begins rotating lateral walls 17 about respective hinges 20 to keep walls 17 contacting wrapping 3 along station SI and throughout transfer of wrapping 3 from pocket 15 to pocket 21 along station S1. As pocket 15 enters station SI, said further control and actuating device moves the corresponding shaft 62 gradually outwards of drum 6 in direction D3, so that plate 64, up to now in the withdrawn rest position close to shoulder 63, engages wrapping 3 longitudinally. Just before plate 64 begins pushing wrapping 3, said further control and actuating device lowers respective hook 65 into the lowered clamping position to clamp collar 4 with respect to wrapping 3 between bar 68 and plate 64, and to clamp wrapping 3 between plate 64 and tooth 67, which engages the far side of initial portion 70 of guide element 69.

At this point, rotation of drum 6 feeds plate 64 and pocket 15 towards transfer station Sl, and plate 64 moves into the first extracted position to gradually extract wrapping 3 and collar 4 from pocket 15, and insert wrapping 3 and collar 4 inside a pocket 21 aligned with pocket 15 in direction D3 and containing a blank 5 in said prefolding configuration, so that wrapping 3 is loaded onto panel 26 and between panels 31. During transfer of wrapping 3 from pocket 15 to pocket 21, tooth 67, formerly positioned contacting initial portion 70 of element 69, moves into contact with oblique intermediate portion 71, and then into contact with connecting portion 74; and, the instant collar 4 contacts wedge-shaped element 75, element 75 is inserted between collar 4 and rod 66 to press central panel 18 of collar 4 against surface 19 of wrapping 3, and to also dislodge bar 68 from collar 4, while still maintaining tooth 67 contacting both element 69 and the end of wrapping 3 opposite the end engaged by plate 64.

Once wrapping 3 is fully inserted inside pocket 21, said further control and actuating device raises hook 65 completely, and backs up shaft 62 in direction D3 to insert plate 64 almost entirely inside pocket 15; at which point, wrapping 3 and collar 4 are kept inside pocket 15 by plate 73, and said two folding elements to the side of lateral walls 23 provide for squarely folding tabs 33. As drum 6 rotates about axis 6*a*, plate 77 folds panel 30 squarely with respect to panel 27, and then folds panel 27 with respect to panel 26 to bring panel 30 substantially onto plate 73; and, at the same time, folding element 78 folds panel 29 onto plate 73. Said further control and actuating device then restores plate 64 to the first extracted position to completely fold panel 27 squarely, to position panel 30 completely on plate 73, and to partially form packet 2, which is completed upon pocket 21 abandoning plate 73 at station S2.

When pocket 21 reaches transfer station S2, longitudinal lateral panels 32 and trapezoidal tabs 35, after abandoning plate 73, contact supporting surfaces 25 and are maintained (in known manner) contacting surfaces 25 until said further control and actuating device moves plate 64 into the second extracted position. Between the first and second extracted position, plate 64 travels through pocket 21 to extract packet 2 from pocket 21, and feeds packet 2 into an orienting pocket 38, while clamping packet 2 in a stable transfer configuration in cooperation with curved end portion 81 of folding element 78. Packet 2 is inserted inside pocket 38 at station S2 with pocket 38 in the loading position with longitudinal axis 49*a* of respective seat 49 parallel to axis 6*a* of drum 6, and with movable walls 50 in the half-closed position; and packet 2 is inserted with panels 31 contacting surfaces 47, with panel 26 contacting surface 46 and substantially closing groove 45, and with panels 32 and tabs 35 projecting outwards of seat 49 on edges 48 and contacting flat portions 55 of walls 50.

As orienting assembly 36 travels about axis 6*a* from station S2 to station SU, respective shaft 37 is rotated about axis 37*a* to vary the angular distance between side by side pockets 38. The circumference of pockets 38, in fact, is smaller in the loading position than in the unloading position, which is why cup-shaped body 39 is fitted to shaft 37 eccentrically with respect to axis 37*a*. Again as assembly 36 travels from station S2 to station SU, said control and actuating device inside body 39 rotates cap 40 about axis 39*a* to rotate seat 49 and set pocket 38 to the unloading position.

By the time assembly 36 reaches station SU, pocket 38 is positioned with respective axis 49*a* parallel to direction D2, and respective seat 49 is engaged by a projection 61; the simultaneous rotation of drum 6 about axis 6*a* and of shaft 37 about axis 37*a* causes pocket 38 to travel at a speed V2 less than the traveling speed V3 of projection 61, and, as pocket 38 travels along branch P2 of path P, pocket 38 is gradually brought radially closer to station SU and to a respective projection 61, so that, when pocket 38 is finally inside station SU, respective packet 2 is engaged at both free ends by two projections 61, which, traveling at a speed V3 substantially greater than speed V2, extract packet 2 partially from seat 49 before pocket 38 leaves station SU completely. Moreover, when pocket 38 is finally inside station SU, elongated plate 58 is inserted inside groove 45 to finally clamp packet 2 in a further stable transfer configuration between loading branch 60 and projections 61.

As pocket 38 moves away from station SU, movable walls 50 are moved into the half-open position, while still engaging panels 32 and tabs 35, however, so that panels 32 and tabs 35 are folded partly about the respective preformed longitudinal bend lines to further weaken blank 5. That is, flat portions 55 of walls 50 fold panels 32 and tabs 35 after pocket 38 moves away from station SU. Between station SU and station S2, pocket 38 of assembly 36 is restored once more to the loading position to receive a further packet 2 at station S2.

The formation of packet 2 along path P therefore calls for much less space as compared with formation along an entirely straight path. Moreover, in the course of each transfer at stations SI, S1, S2 and SU, wrapping 3 and packet 2 are prevented from collapsing by being clamped at all times in the respective stable transfer configurations. Finally, assemblies 36 provide for supplying packets 2 to output device 11 with panels 32 and tabs 35 parallel to traveling direction D3, thus enabling panels 32 and tabs 35 to be subsequently gummed and folded.

I claim:

1. A packing machine for producing semi-finished packets of cigarettes, each comprising an inner wrapping (3), a collar (4), and a blank (5) of packing material partially folded about the inner wrapping (3) and the collar (4), the machine (1) comprising a packing path (P) having an input branch (P1), an intermediate branch (P2) and an output branch (P3), the intermediate branch (P2) being connected to the input and output branches (P1, P3) at an input station (SI) and an output station (SU) respectively; input conveying means (12) extending along the input branch (P1) to feed, in a given first direction (D1), a succession of inner wrappings (3) crosswise to respective longitudinal axes **(3*a*; 2*a*) and with a given first orientation; packing conveying means (9) extending between a first and a second transfer station (S1, S2) located along said intermediate branch (P2) to receive said inner wrappings (3) at the first transfer station (S1), and to partially enclose the inner wrappings (3) in respective blanks (5) of packing material to form said semi-finished packets (2); orienting conveying means (10) located along said intermediate branch (P2) to receive the packets (2) at the second transfer station (S2), and to orient the inner wrappings (3) and respective packets (2); output conveying means (11) located along the output branch (P3) to feed the packets (2) in a given second direction (D2) and parallel to respective longitudinal axes (3*a*; 2*a*) coincident with the longitudinal axes (3*a*; 2*a*) of the respective inner wrappings (3), and with a given second orientation rotated 90° with respect to the first orientation; and transfer means (13) associated with said conveying means (12, 9, 10) to transfer said inner wrappings (3) at said first transfer station (S1), and said packets (2) at said second transfer station (S2); the machine (1) being characterized in that said given directions (D1, D2) are parallel; said input and output branches (P1, P3) are straight branches; and said intermediate branch (P2) winds substantially in a spiral about a given axis (6*a*)** crosswise to said given directions (D1, D2).

2. A machine as claimed in claim 1, characterized by comprising a forming drum (6) mounted to rotate continuously about said given axis **(6*a*), and in turn comprising a first inner transmission section (8) for said input conveying means (12), a second intermediate folding section (9) defined by said packing conveying means (9), and a third outer orienting section (10) defined by said orienting conveying means (10); said sections (8, 9, 10) being arranged side by side with one another and crosswise to said given axis (6*a*)**, and extending at least partly along said intermediate branch (P2).

3. A machine as claimed in claim 2, characterized in that said first direction (D1) is tangent to said first inner transmission section (8) of the drum (6), and said second direction (D2) is tangent to said third outer orienting section (10) of the drum (6); the first inner transmission section and third outer orienting section (8, 10) substantially being cylindrical sections coaxial with said given axis **(6*a*)**.

4. A machine as claimed in claim 3, characterized in that said input and output branches (P1, P3) are aligned with each other.

5. A machine as claimed in claim 2, characterized in that said transfer means (13) are supported by said drum (6), and are movable in a transfer direction (D3) parallel to said given axis **(6*a*); the transfer means (13) comprising clamping means (13) for clamping said inner wrappings (3), the respective collars (4), and said packets (2)** in respective stable transfer configurations.

6. A machine as claimed in claim 2, characterized in that said input conveying means (12) comprise a conveyor belt (14) looped about said first inner transmission section (8), and a number of conveying pockets (15) for conveying said inner wrappings (3) and respective collars (4); the first inner transmission section (8) defining a transmission for said conveyor belt (14).

7. A machine as claimed in claim 6, characterized in that the conveyor belt (14) is tangent to the first inner transmission section (8) at said input station (SI).

8. A machine as claimed in claim 6, characterized in that said packing conveying means (9) comprise a number of folding pockets (21) aligned with said conveying pockets (15) at least at said first transfer station (S1); the folding pockets (21) being equally spaced along the second intermediate folding section (9) and about said given axis **(6*a*)**.

9. A machine as claimed in claim 8, characterized in that said folding pockets (21) each comprise lateral walls (23) parallel to said given axis **(6*a*) and for retaining a respective blank (5)** of packing material in a given prefolding configuration.

10. A machine as claimed in claim 9, characterized in that said second intermediate folding section (9) comprises folding means (69, 77, 78) for folding said blank (5) inside a respective said folding pocket (21) and about the respective inner wrapping (3) to form a respective semi-finished packet (2).

11. A machine as claimed in claim 8, characterized in that said orienting conveying means (10) comprise a number of orienting assemblies (36), in turn comprising respective orienting pockets (38) aligned with said folding pockets (21) at least at said second transfer station (S2).

12. A machine as claimed in claim 11, characterized in that said orienting pockets (38) are variable-geometry pockets, and each comprise two fixed walls (42) and two orientable walls (50) orientable with respect to the fixed walls (42); the fixed walls (42) defining a U-shaped seat (49) having a rectangular cross section and for housing a semi-finished packet (2).

13. A machine as claimed in claim 12, characterized in that said orientable walls (50) are movable, with respect to said fixed walls (42), between a half-closed position in which the orientable walls (50) are located substantially close to each other and substantially closing said seat (49), and a half-open position in which the orientable walls (50) are spaced apart to weaken respective free portions of the respective semi-finished packet (2).

14. A machine as claimed in claim 12, characterized in that said seats (49) have respective long longitudinal axes **(49*a*); said orienting assemblies (36) comprising rotary orienting means (40) supporting said fixed and orientable walls (42, 50) to rotate the respective seats (49) between a loading position in which the respective long longitudinal axes (49*a*) of the seats (49) are oriented parallel to said given axis (6*a*), and an unloading position in which the respective long longitudinal axes (49*a*) of the seats (49) are oriented crosswise to said given axis (6*a*)** and parallel to said second direction (D2).

15. A machine as claimed in claim 14, characterized in that said orienting assemblies (36) comprise respective supporting shafts (37) mounted for rotation through said third outer orienting section (10) to rotate about respective axes **(37*a*) of rotation parallel to said given axis (6*a*); and respective supporting elements (39) connected to the respective supporting shafts (37) eccentrically with respect to the respective axes (37***a*) of rotation.

16. A machine as claimed in claim 15, characterized in that said supporting elements (39) extend along respective axes (39*a*) of orientation crosswise to said axes (37*a*) of rotation and said long longitudinal axes (49*a*); said rotary orienting means (40) being connected in rotary manner to the respective supporting elements (39) to rotate about said axes (39*a*) of orientation.

17. A machine as claimed in claim 8, characterized in that said transfer means (13) comprise, for each said folding pocket (21), a push element (62, 64) movable, in said transfer direction (D3) and through said conveying and folding pockets (15, 21), between a withdrawn rest position, and a first and a second extracted work position in which the push element (62, 64) is located through a said conveying pocket (15) and through a said folding pocket (21) respectively.

18. A machine as claimed in claim 17, characterized in that said clamping means (13) comprise a plate (64) defining part of said push element (62, 64) and for longitudinally engaging a respective inner wrapping (3) at said first transfer station (S1); and a clamping hook (65) fitted to the push element (62, 64) and movable, with respect to said plate (64), between a raised position, and a lowered clamping position in which the hook (65) cooperates with said plate (64) to clamp the respective inner wrapping (3) and the collar (4) in a stable transfer configuration.

19. A machine as claimed in claim 18, characterized in that said clamping means (13) comprise a clamping element (68) integral with said hook (65) and for clamping a respective collar (4) with respect to the respective inner wrapping (3).

20. A machine as claimed in claim 18, characterized in that said folding means (69, 77, 78) comprise guide means (69) for guiding said hook (65) and cooperating with the hook (65) to clamp the collar (4) and the inner wrapping (3); the guide means (69) extending along said input branch (P1) and along said intermediate branch (P2) astride said input station (S1) and said first transfer station (S1).

21. A machine as claimed in claim 6, characterized in that said conveying pockets (15) for conveying said inner wrappings (3) and respective collars (4) comprise respective pairs of oscillating walls (17) mounted for rotation with respect to the respective conveyor belt (14).

22. A machine as claimed in claim 2, characterized in that said output conveying means (11) comprise a respective conveyor belt (59) substantially tangent to the third outer orienting section (10) at said output station (SU).

23. A packing machine for producing semi-finished packets of cigarettes, each comprising an inner wrapping (3), a collar (4), and a blank (5) of packing material partially folded about the inner wrapping (3) and the collar (4); the machine (1) being characterized by comprising forming means (6) rotating continuously about a given axis (6*a*) to form about each inner wrapping (3) a respective semi-finished packet (2) having a longitudinal axis (3*a*; 2*a*); and at least one orienting assembly (36) for orienting each semi-finished packet (2) from a first to a given second orientation wherein the packet (2) is oriented with the respective longitudinal axis (3*a*; 2*a*) parallel to an output direction (D2) of said forming means (6).

24. A machine as claimed in claim 23, characterized by comprising a number of orienting assemblies (36) supported by said forming means (6) and equally spaced about said given axis (6*a*).

25. A machine as claimed in claim 23, characterized in that said orienting assembly (36) comprises an orienting pocket (38) of variable geometry and in turn comprising two fixed walls (42) and two orientable walls (50) orientable with respect to the fixed walls (42); the fixed walls (42) defining a U-shaped seat (49) having a rectangular cross section and for housing a semi-finished packet (2).

26. A machine as claimed in claim 25, characterized in that said orientable walls (50) are movable, with respect to said fixed walls (42), between a half-closed position in which the orientable walls (50) are located substantially close to each other and substantially closing said seat (49), and a half-open position in which the orientable walls (50) are spaced apart to weaken respective free portions of the respective semi-finished packet (2).

27. A machine as claimed in claim 25, characterized in that said seats (49) have respective long longitudinal axes (49*a*); said orienting assemblies (36) comprising rotary orienting means (40) supporting said fixed and orientable walls (42, 50) to rotate the respective seats (49) between a loading position in which the respective long longitudinal axes (49*a*) of the seats (49) are oriented parallel to said given axis (6*a*), and an unloading position in which the respective long longitudinal axes (49*a*) of the seats (49) are oriented crosswise to said given axis (6*a*) and parallel to said output direction (D2).

28. A machine as claimed in claim 27, characterized in that said orienting assemblies (36) comprise respective supporting shafts (37) mounted for rotation with respect to said forming means (6) to rotate about respective axes (37*a*) of rotation parallel to said given axis (6*a*); and respective supporting elements (39) connected to the respective supporting shafts (37) eccentrically with respect to the respective axes (37*a*) of rotation.

29. A machine as claimed in claim 28, characterized in that said supporting elements (39) extend along respective axes (39*a*) of orientation crosswise to said axes (37*a*) of rotation and said long longitudinal axes (49*a*); said rotary orienting means (40) being connected in rotary manner to the respective supporting elements (39) to rotate about said axes (39*a*) of orientation.

30. A packing machine for producing semi-finished packets of cigarettes, each comprising an inner wrapping (3), a collar (4), and a blank (5) of packing material partially folded about the inner wrapping (3) and the collar (4); the machine (1) being characterized by comprising forming means (6) rotating continuously about a given axis (6*a*) to form about each inner wrapping (3) a respective semi-finished packet (2) having a longitudinal axis (2*a*; 3*a*); and clamping means (13) for clamping each inner wrapping (3) and the respective semi-finished packet (2) in respective stable transfer configurations.

31. A machine as claimed in claim 30, characterized in that said clamping means (13) comprise a plate (64) for longitudinally engaging a respective inner wrapping (3); and a clamping hook (65) movable, with respect to said plate (64), between a raised position, and a lowered clamping position in which the hook (65) cooperates with said plate (64) to clamp the respective inner wrapping (3) and the collar (4) in a stable transfer configuration.

32. A machine as claimed in claim 31, characterized in that said clamping means (13) comprise a clamping element (68) integral with said hook (65) and for clamping a respective collar (4) with respect to the respective inner wrapping (3).

* * * * *